US009290971B2

(12) United States Patent
Amagai et al.

(10) Patent No.: US 9,290,971 B2
(45) Date of Patent: Mar. 22, 2016

(54) DOOR DEVICE FOR VEHICLE

(75) Inventors: Toyohisa Amagai, Wako (JP); Kinji Hoshikawa, Wako (JP); Hiromu Inoue, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 56 days.

(21) Appl. No.: 14/009,389

(22) PCT Filed: Feb. 28, 2012

(86) PCT No.: PCT/JP2012/054878

§ 371 (c)(1), (2), (4) Date: Oct. 2, 2013

(87) PCT Pub. No.: WO2012/137558

PCT Pub. Date: Oct. 11, 2012

(65) Prior Publication Data

US 2014/0013667 A1 Jan. 16, 2014

(30) Foreign Application Priority Data

Apr. 7, 2011 (JP) ..... 2011-085609

(51) Int. Cl.

| | |
|---|---|
| ***E05B 85/12*** | (2014.01) |
| ***E05B 79/20*** | (2014.01) |
| ***E05B 53/00*** | (2006.01) |
| ***E05B 79/06*** | (2014.01) |
| ***E05B 79/22*** | (2014.01) |

(52) U.S. Cl.

CPC ..... *E05B 85/12* (2013.01); *E05B 53/003* (2013.01); *E05B 79/06* (2013.01); *E05B 79/20* (2013.01); *E05B 79/22* (2013.01); *E05B 85/13* (2013.01)

(58) Field of Classification Search

IPC ..... E05B 85/12,85/13, 53/003, 53/005, E05B 85/10, 85/36

See application file for complete search history.

(56) References Cited

U.S. PATENT DOCUMENTS

| | | | | |
|---|---|---|---|---|
| 7,387,282 | B2 * | 6/2008 | Kovac | 248/74.4 |
| 2005/0067539 | A1 * | 3/2005 | Fannon et al. | 248/65 |
| 2010/0171325 | A1 * | 7/2010 | Takagai et al. | 292/336.3 |
| 2011/0175377 | A1 * | 7/2011 | Tanaka et al. | 292/336.3 |
| 2011/0241360 | A1 * | 10/2011 | Kitamura | 292/201 |
| 2013/0038074 | A1 * | 2/2013 | Mori et al. | 292/336.3 |

FOREIGN PATENT DOCUMENTS

| | | |
|---|---|---|
| EP | 1 600 586 | * 11/2005 |
| JP | 08-188116 | 7/1996 |

(Continued)

OTHER PUBLICATIONS

International Search Report dated Mar. 16, 2012.

*Primary Examiner* — Gregory Strimbu
(74) *Attorney, Agent, or Firm* — Rankin, Hill & Clark LLP

(57) ABSTRACT

A door device for a vehicle includes a cable for connecting a handle device and a lock unit. A cable holding member mounted to the handle device is displaced between an engagement position in which the cable holding member engages with the cable and a non-engagement position in which the cable holding member does not engage with the cable. A contact portion of a door panel is configured such that when the handle device is being mounted to the door panel, the contact portion contacts the cable holding member in the non-engagement position and interferes with the assembly of the handle device to the door panel and the contact portion does not contact the cable holding member in the engagement position.

7 Claims, 13 Drawing Sheets

(56) References Cited

FOREIGN PATENT DOCUMENTS

| | | | |
|---|---|---|---|
| JP | 2006-169806 | 6/2006 | |
| JP | 2007-313942 | * | 12/2007 |
| JP | 2010-159584 | | 7/2010 |
| JP | 2010-159593 | | 7/2010 |

* cited by examiner

DOOR DEVICE FOR VEHICLE

TECHNICAL FIELD

The present invention relates to a vehicular door apparatus including a door body movable to open and close a door opening of a vehicle body, a handle device attached to a door panel of the door body, a lock unit for engaging the door body with the vehicle body, and a cable interconnecting the handle device and the lock unit.

BACKGROUND

A vehicular door apparatus including a door body movable to open and close a door opening of a vehicle body, and a handle device attached to a door panel of the door body is known as disclosed in, for example, JP-A-2010-159584. The handle device includes an inner handle for unlocking a lock unit, a cable for transmitting to the lock unit an operational force exerted on the inner handle, and a handle base carrying the inner handle and the cable. The handle base has a handle base attachment portion for attaching the handle base to the door panel, and a cable clamp (a cable holding member) for supporting the cable.

As for the vehicular door apparatus disclosed in patent literature 1, the cable clamp (the cable holding member) of the handle base assures support for the cable.

In the vehicular door apparatus of patent literature 1, the cable clamp (the cable holding member) is pivotably attached to the handle base. In assembling the door, an operator sets the cable in a U-shaped groove formed on the handle base, after which the operator makes the cable clamp pivot into engagement with the cable to secure the cable to the handle base.

However, it is likely that the cable shakes or comes out of the handle base due to vibration etc. occurring during driving of the vehicle if the operator forgets to make the cable clamp pivot after setting the cable in the U-shaped groove. Therefore, it is necessary to perform an additional operation of confirming whether the cable clamp is in a predetermined engaging position. This operation makes it difficult to improve a work of assembling the cable clamp.

SUMMARY OF INVENTION

It is an object of the present invention is to provide a vehicular door apparatus allowing for judgment of whether a cable holding member is in an engaging position so as to eliminate an additional operation of confirming whether the cable holding member is in the engaging position in attaching a handle device to a door panel.

According to one aspect of the present invention, there is provided a vehicular door apparatus comprising: a door body for opening and closing a door opening of a vehicle body; a handle device to be attached to a door panel of the door body; a lock unit for engaging the door body with the vehicle body; a cable interconnecting the handle device and the lock unit; a cable holding member attached to the handle device and movable between an engaging position in which the cable holding member engages the cable and a non-engaging position in which the cable holding member does not engage the cable, wherein the door panel has an interference portion to interfere with the cable holding member in the non-engaging position and avoid interfering with the cable holding member in the engaging position when the handle device is attached to the door panel.

Preferably, the cable holding member includes a protrusion portion. When the cable holding member is in the non-engaging position, the protrusion portion protrudes toward the door panel more than a door-panel-side end portion of the handle device, the door-panel-side end portion being located close to the interference portion of the door panel, and when the cable holding member is in the engaging position, the protrusion portion is disposed in a stowed position closer to an inside of the handle device than the door-panel-side end portion. The protrusion portion interferes with the interference portion when the cable holding member is in the non-engaging position.

Preferably, the door-panel-side end portion abuts on the interference portion when the handle device is attached to the door panel.

Preferably, the handle device includes an attachment portion to which the cable holding member is attached, and the door-panel-side end portion is located near the attachment portion.

Preferably, the cable holding member is pivotably attached to the attachment portion through a pivotal shaft of the cable holding member, and the door-panel-side end portion is located in a region through which a line extending from a center of the pivotal shaft perpendicularly to the interference portion passes.

Preferably, the door-panel-side end portion is an abutment rib protruding toward the interference portion.

Preferably, the door-panel-side end portion is located on a side of a longitudinal end of the handle device.

Preferably, the handle device includes handle device attaching portions located on a side of a longitudinal opposite end of the handle device for attaching the handle device to the door panel.

The door panel has the interference portion to interfere with the cable holding member in the non-engaging position and avoid interfering with the cable holding member in the engaging position when the handle device is attached to the door panel. By virtue of the interference portion, it is possible to judge whether the cable holding member is in the engaging position in attaching the handle device to the door panel. In other words, there is no need to perform an additional operation of confirming whether the cable holding member is in the engaging position. As a result, a work of assembling the cable holding member can be improved.

The cable holding member includes the protrusion portion. When the cable holding member is in the non-engaging position, the protrusion portion protrudes toward the door panel more than the door-panel-side end portion of the handle device located close to the interference portion of the door panel, and when the cable holding member is in the engaging position, the protrusion portion is disposed in the stowed position closer to the inside of the handle device than the door-panel-side end portion. The protrusion portion interferes with the interference portion when the cable holding member is in the non-engaging position. It is thus possible to eliminate an additional operation of confirming whether the cable holding member is in the engaging position. As a result, a work of assembling the cable holding member can be improved.

The door-panel-side end portion abuts on the interference portion when the handle device is attached to the door panel. The abutment of the door-panel-side end portion on the interference portion prevents the handle device from rattling. Since the interference portion is used to prevent the rattling of the handle device, a structure of the handle device can be simplified.

The handle device includes an attachment portion to which the cable holding member is attached, and wherein the door-panel-side end portion is located near the attachment portion.

Since the attachment portion to which the cable holding member is attached is oriented in such a direction as to abut on the interference portion, the cable holding member can be more rigidly attached to the attachment portion, thereby effectively restraining shake of the cable.

The cable holding member is pivotably attached to the attachment portion through the pivotal shaft of the cable holding member, and the door-panel-side end portion is located in the region through which the line extending from the center of the pivotal shaft perpendicularly to the interference portion passes. The pivotal shaft can be thus supported due to the abutment on the interference portion. As a result, the cable holding member can be more rigidly attached to the attachment portion.

The door-panel-side end portion is the abutment rib protruding toward the interference portion, and hence the attachment portion provides increased rigidity.

The door-panel-side end portion is located on the side of the longitudinal one end of the handle device. That is, the longitudinal one end of the handle device can be supported by the interference portion. As a result, it becomes possible to more effectively restrain rattling of the handle device.

The side of the one end of the handle device is supported by the interference portion and the handle device attaching portions are located on the side of the longitudinal opposite end of the handle device. That is, the handle device attaching portions are efficiently disposed and rattling of the handle device is effectively restrained.

DETAILED DESCRIPTION

A certain preferred embodiment of the present invention is described below with reference to the accompanying drawings.

Figure 1:
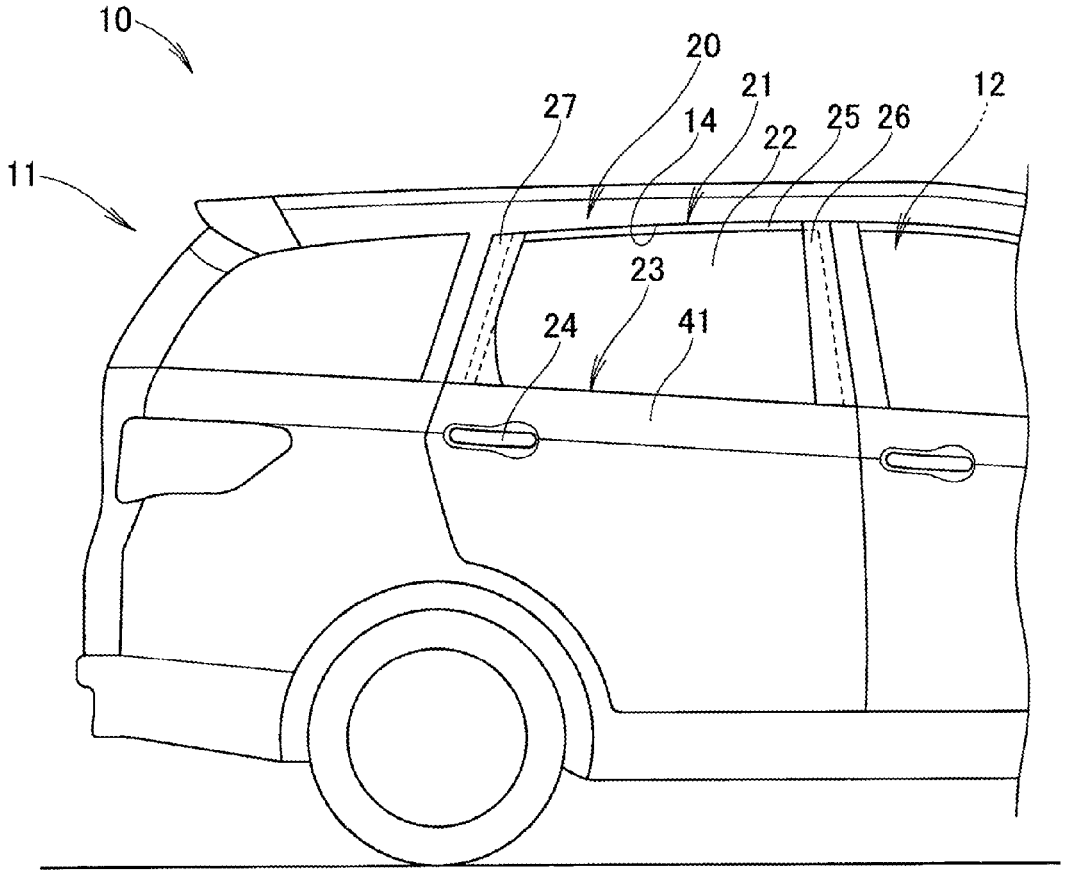
FIG. 1 is a side elevation view of a vehicle employing a vehicular door apparatus in an embodiment of the present invention.

As shown in FIG. 1, a vehicle 10 has a door opening 14 formed in a vehicle body 11 thereof for allowing a passenger to get in and out of the vehicle 10. A vehicular door 20 is attached to the door opening 14 for opening and closing the door opening 14. The vehicular door 20 is a rear door disposed at a rear part of the vehicle body 11, and includes a door body 21 for opening and closing the door opening 14, and a door glass 22 movable up and down along the door body 21.

The door body 21 includes a door panel 23 covering a lateral outer side of the vehicle body 11, an outer handle 24 disposed on the outside of the door panel 23 for opening and closing the door body 21, a door sash 25 disposed on an upper portion of the door panel 23 for guiding the door glass 22, a front garnish 26 covering a front outer portion of the door sash 25, and a rear garnish 27 covering a rear outer portion of the door sash 25.

As shown in FIG. 1 to FIG. 4, the door body 21 carries a handle device 31 in a passenger compartment 12. The handle device 31 is attached to the door panel 23 for locking and unlocking the door body 21. The door body 21 also carries a latch device 33 for engaging the door body 21 with a striker 29 disposed on the vehicle body 11 (the door opening 14). The door body 21 further carries a cable (a latch-side cable) 35 interconnecting the handle device 31 and the latch device 33, and a lock device 34 for locking the latch device 33. In addition, the door body 21 carries a lock-side cable 36 interconnecting the handle device 31 and the lock device 34, and interior parts 37 covering the inside of the door panel 23 in the passenger compartment 12.

The door panel 23 includes an outer panel 41 forming the exterior of the vehicle body, an inner panel 42 disposed on the outer panel 41 and in the passenger compartment 12, and an impact beam 43 disposed between the outer panel 41 and the inner panel 42 for increasing strength and rigidity of the door panel 23.

The inner panel 42 has an interference portion 44 (FIG. 4 and FIG. 11) to interfere with a cable holding member (a latch-side cable holding member) 58 (FIG. 5 and FIG. 10) in a non-engaging position A2 (FIG. 13) set forth later, and avoid interfering with the cable holding member 58 in an engaging position A1 (FIG. 12) set forth later. The latch device 33 and the lock device 34 together define a lock unit 32.

The handle device 31 includes an inner handle 52, a lock knob 56 and a decorative cover 57. The interior parts 37 include a door lining 46 covering the inner panel 42 of the door panel 23, and an armrest 47 located a substantially vertically middle portion of the door lining 46 and extending in a front-and-rear direction of the vehicle body.

The door lining 46 has a storage portion 48 formed thereon for storing articles. The armrest 47 has a pull (a "pull pocket") 49 to open and close the door body 21, and a door glass control switch (not shown) for moving the door glass 22 up and down.

As shown in FIG. 5 to FIG. 13, the handle device (an inside door handle device) 31 includes a handle base 51 attached to the inner panel 42, and the inner handle (operational handle) 52 pivotably attached to the handle base 51 through a pivot 77 (FIG. 11) of the handle base 51, a return spring 54 (FIG. 11) for returning the inner handle 52, the lock knob 56 pivotably attached to the handle base 51 through a pivot boss (not shown), and the decorative cover 57 (FIG. 2) covering the handle base 51 on a side of the passenger compartment 12. The handle device 31 carries the cable holding member (the latch-side cable holding member) 58 for holding the cable (the latch-side cable) 35 and a lock-side cable holding member 59 for holding the lock-side cable 36.

Figure 9:
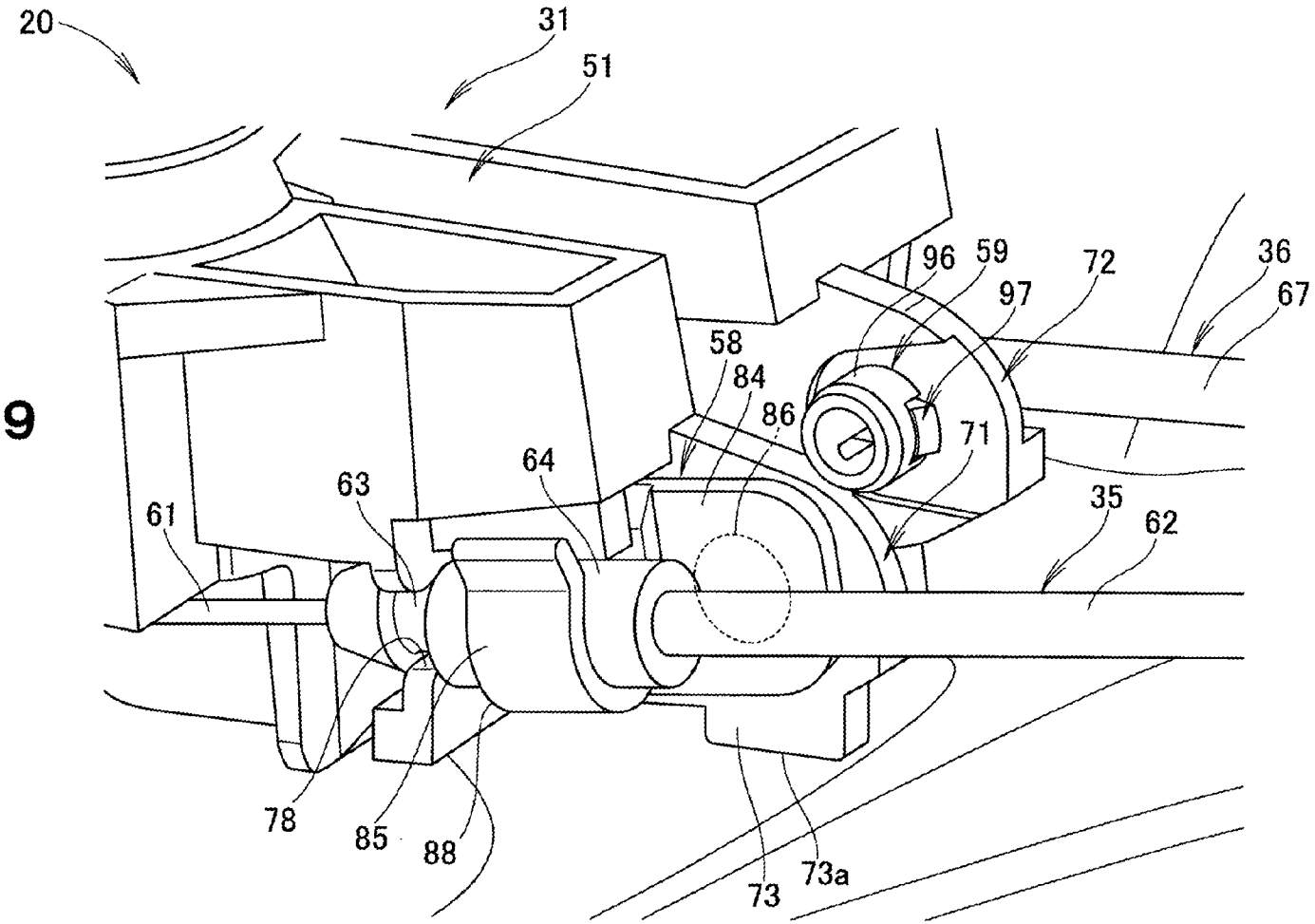
FIG. 9 is a perspective view of the cable holding member shown in FIG. 7 as the cable holding member is in a pivoted position attached to the cable.

As shown in FIG. 9, the cable (the latch-side cable) 35 includes an inner cable 61 interconnecting the handle device 31 and the latch device 33 (FIG. 3), and an outer tube 62 slidably supporting the inner cable 61. The outer tube 62 includes a fitting groove 63 fittingly engaging the handle base 51 of the handle device 31, and a tubular portion 64 supported on a side of the handle base 51 of the handle device 31.

Similarly to the cable (the latch-side cable) 35, the lock-side cable 36 includes an inner cable (not shown) interconnecting the handle device 31 and the lock device 34 (FIG. 3), and an outer tube 67 slidably supporting the inner cable. The outer tube 67 includes a fitting groove (not shown) fittingly engaging the handle base 51 of the handle device 31, and a tubular portion (not shown) supported on a side of the handle base 51 of the handle device 31.

Figure 2:
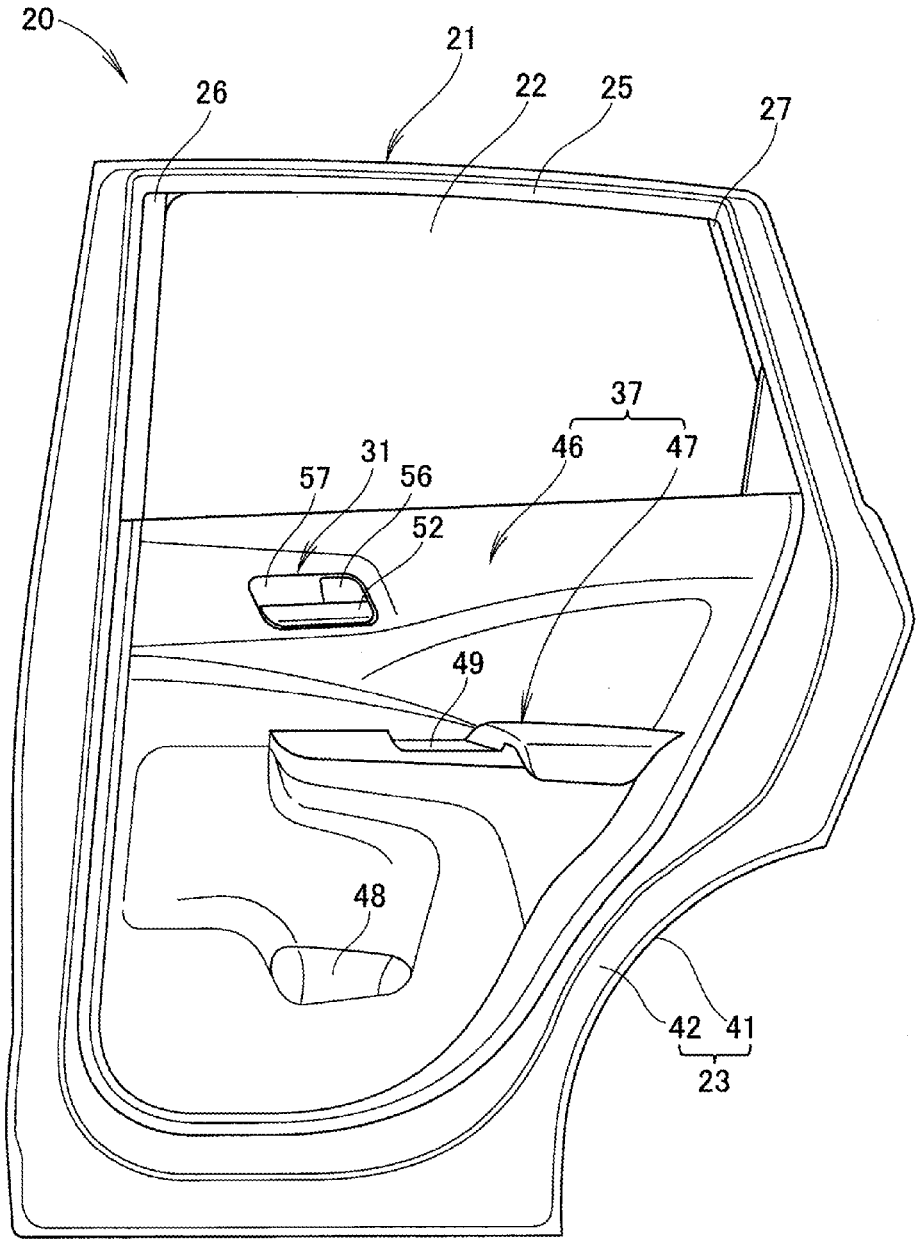
FIG. 2 is a perspective view of a vehicular door shown in FIG. 1 as the door is viewed from within a passenger compartment.

As shown in FIG. 5 to FIG. 11, the handle base 51 includes an attachment portion (a latch-side attachment portion) 71 which the cable holding member (the latch-side cable holding member) 58 pivotably (rotatably) engages, and a lock-side attachment portion 72 which the lock-side cable holding member 59 pivotably (rotatably) engages. The handle base 51 also includes a door-panel-side end portion 73 disposed on a side of longitudinal one end 31*a* (FIG. 11) of the handle device 31 for abutment on the inner panel 42, and handle device attaching portions 91, 92 (FIG. 5) for attaching the handle base 51 to the inner panel 42. The handle base 51 further includes the pivot 77 (FIG. 11) pivotably supporting the inner handle 52, a latch fitting portion 78 (FIG. 9) for fittingly engaging the cable (the latch-side cable) 35, a lock-side fitting portion (not shown) for fittingly receiving the lock-side cable 36, and door lining engaging portions 74, 75, 76 for attaching the handle base 51 to the door lining 46 (FIG. 2).

Figure 10:
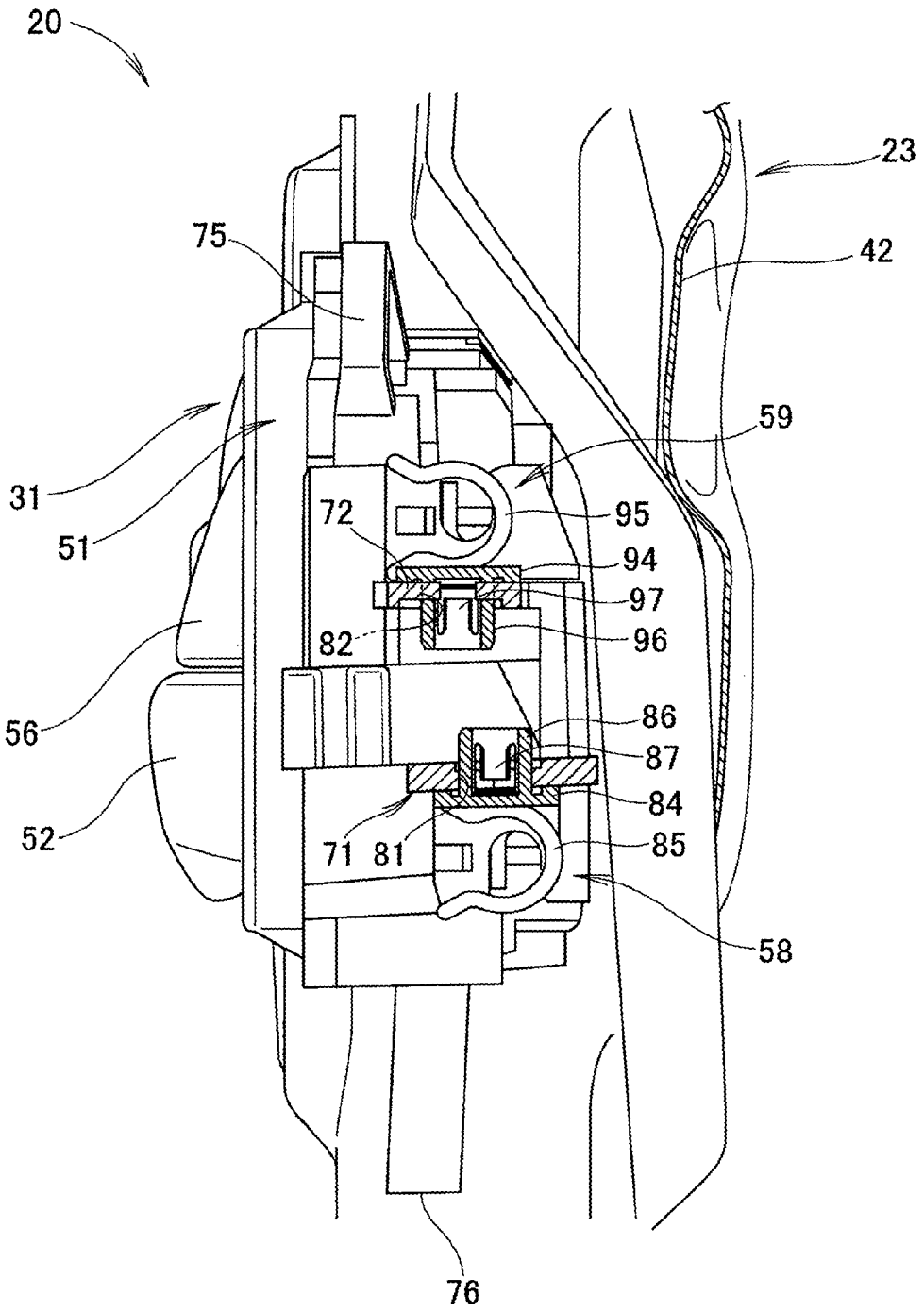
FIG. 10 is a cross-sectional view taken along line 10-10 of FIG. 5.

The attachment portion (the latch-side attachment portion) 71 has an engagement hole 81 which the cable holding member (the latch-side cable holding member) 58 pivotably engages, as shown in FIG. 10. The lock-side attachment portion 72 has an engagement hole 82 which the lock-side cable holding member 59 pivotably engages.

Figure 4:
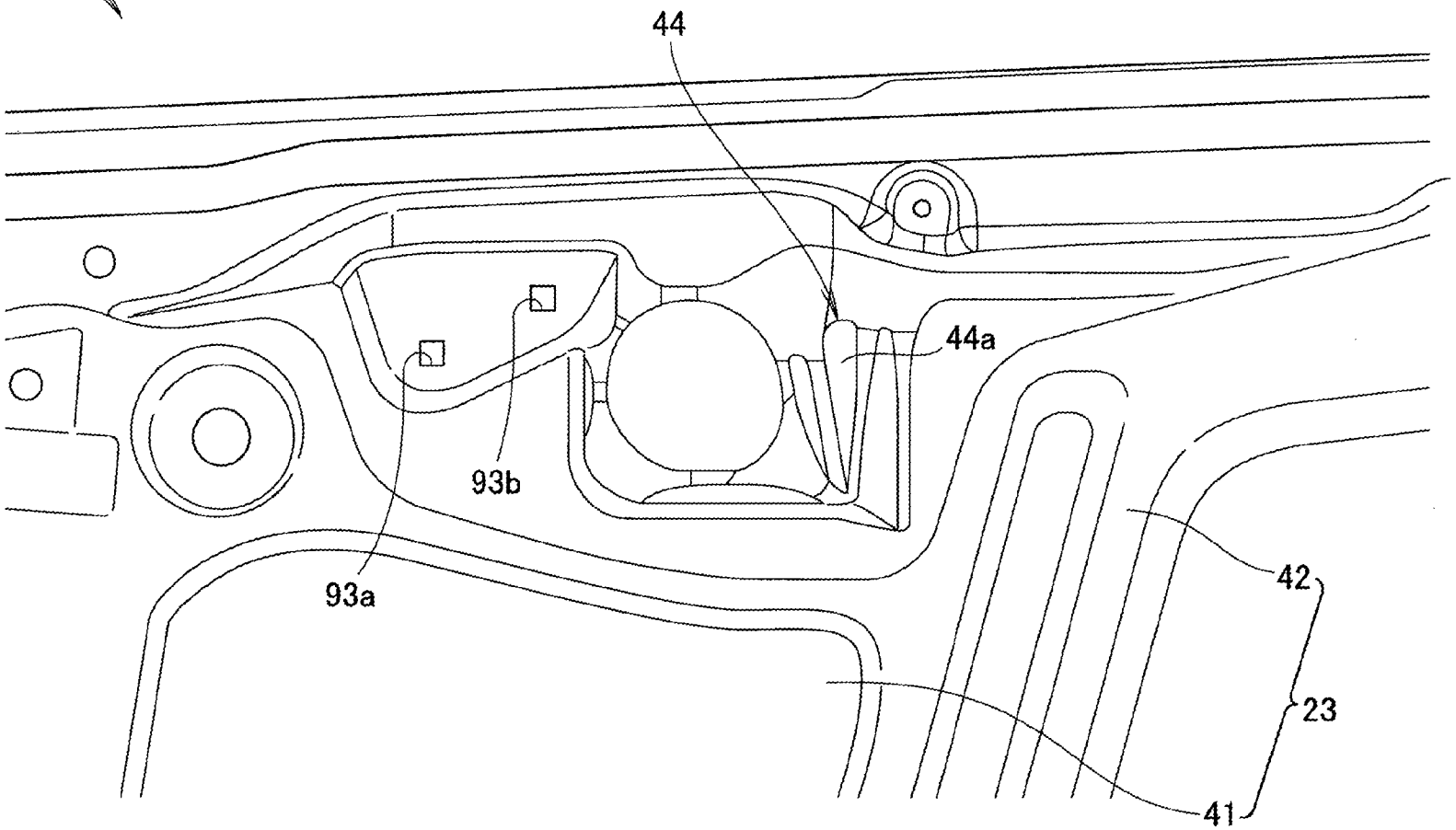
FIG. 4 is a perspective view of the door panel shown in FIG. 2.
Figure 5:
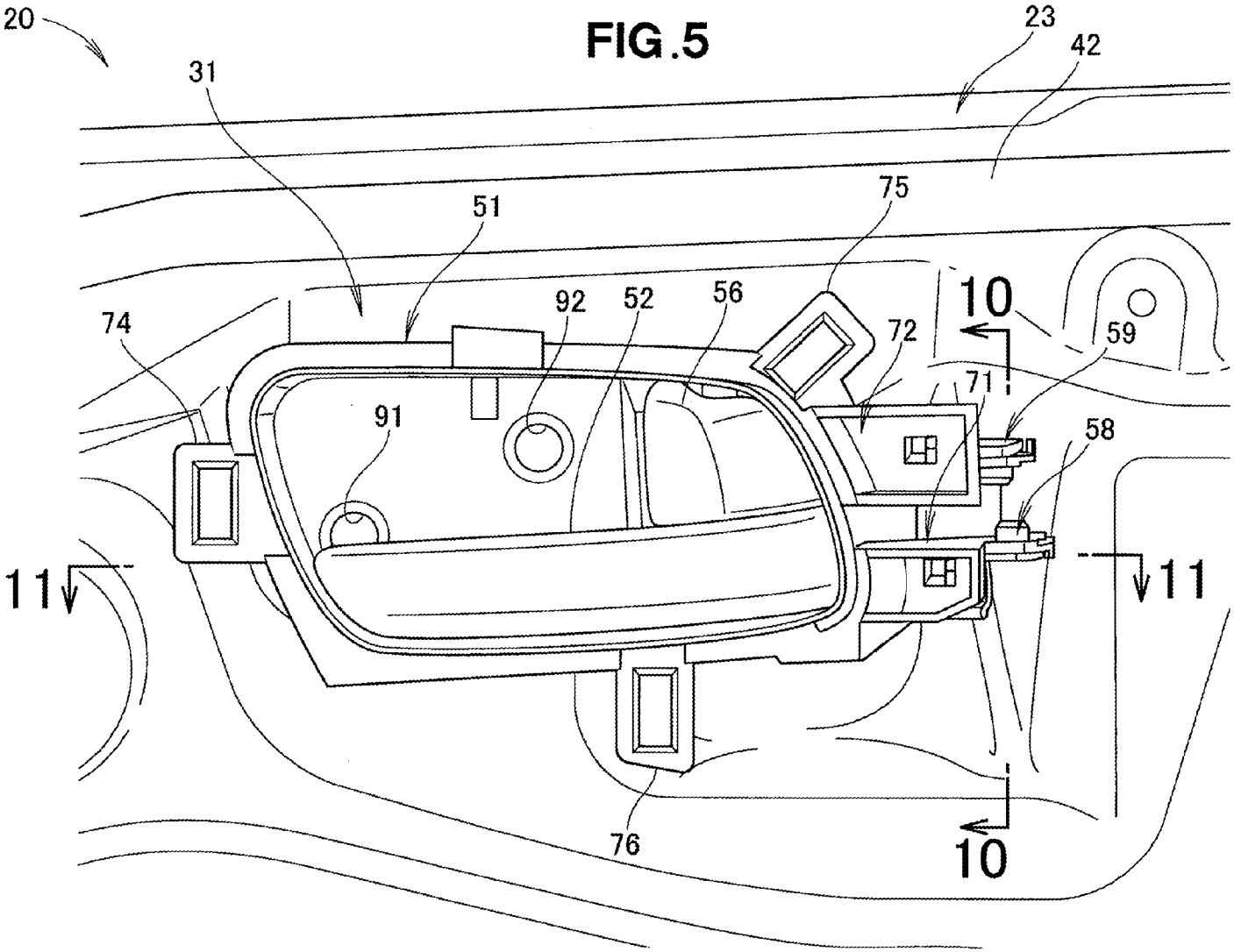
FIG. 5 is a perspective view of the handle device shown in FIG. 3.

As shown in FIG. 5, the handle device attaching portions 91, 92 are portions attaching the handle device 31 to the door panel 23. The handle device attaching portions 91, 92 are located on a side of a longitudinal opposite end 31*b* (FIG. 11) of the handle device 31. As shown in FIG. 4, the inner panel 42 of the door panel 23 has fastening holes 93*a*, 93*b* (FIG. 4) for attachment of the handle device attaching portions 91, 92 to the inner panel 42 by means of clips (not shown). It is noted that a longitudinal direction of the handle device 31 is substantially the same as a front-and-rear direction of the vehicle body 11.

Figure 8:
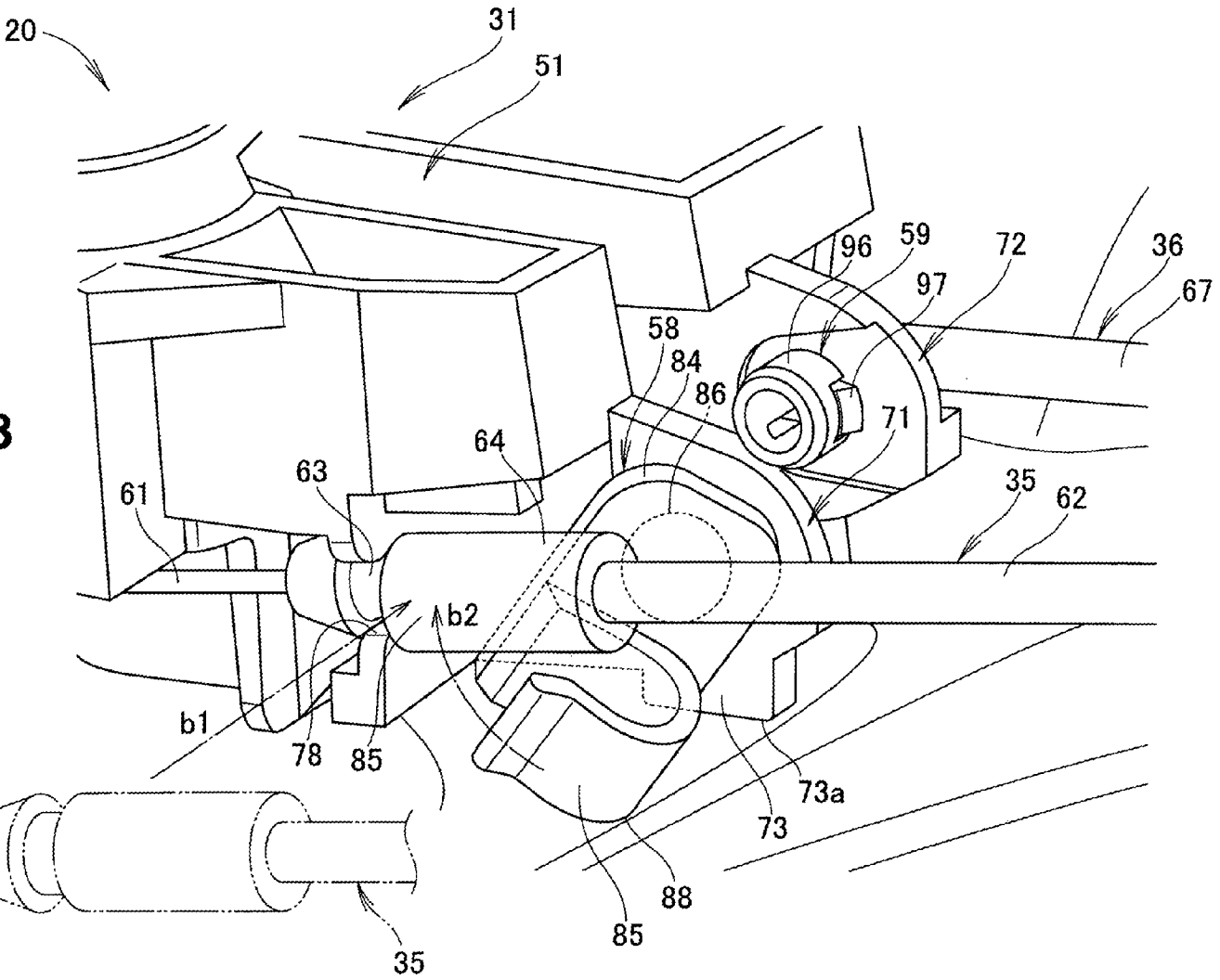
FIG. 8 is a perspective view of the cable holding member shown in FIG. 7 before pivoting of the cable holding member.

As shown in FIG. 8 and FIG. 10, the cable holding member (the latch-side cable holding member) 58 includes a base portion 84 abutting on the attachment portion (the latch-side attachment portion) 71, a U-shaped cable fitting portion 85 formed on one side of the base portion 84 for holding the cable (the latch-side cable) 35, a pivotal shaft 86 formed on an opposite side of the base portion 84 and pivotably engaging the engagement hole 81 (FIG. 10) of the attachment portion 71, and engagement teeth 87, 87 (only one shown) formed on the pivotal shaft 86 and engaging the attachment portion 71. The cable holding member (the latch-side cable holding member) 58 is pivotably supported by the attachment portion (the latch-side attachment portion) 71 through the pivotal shaft 86.

Figure 12:
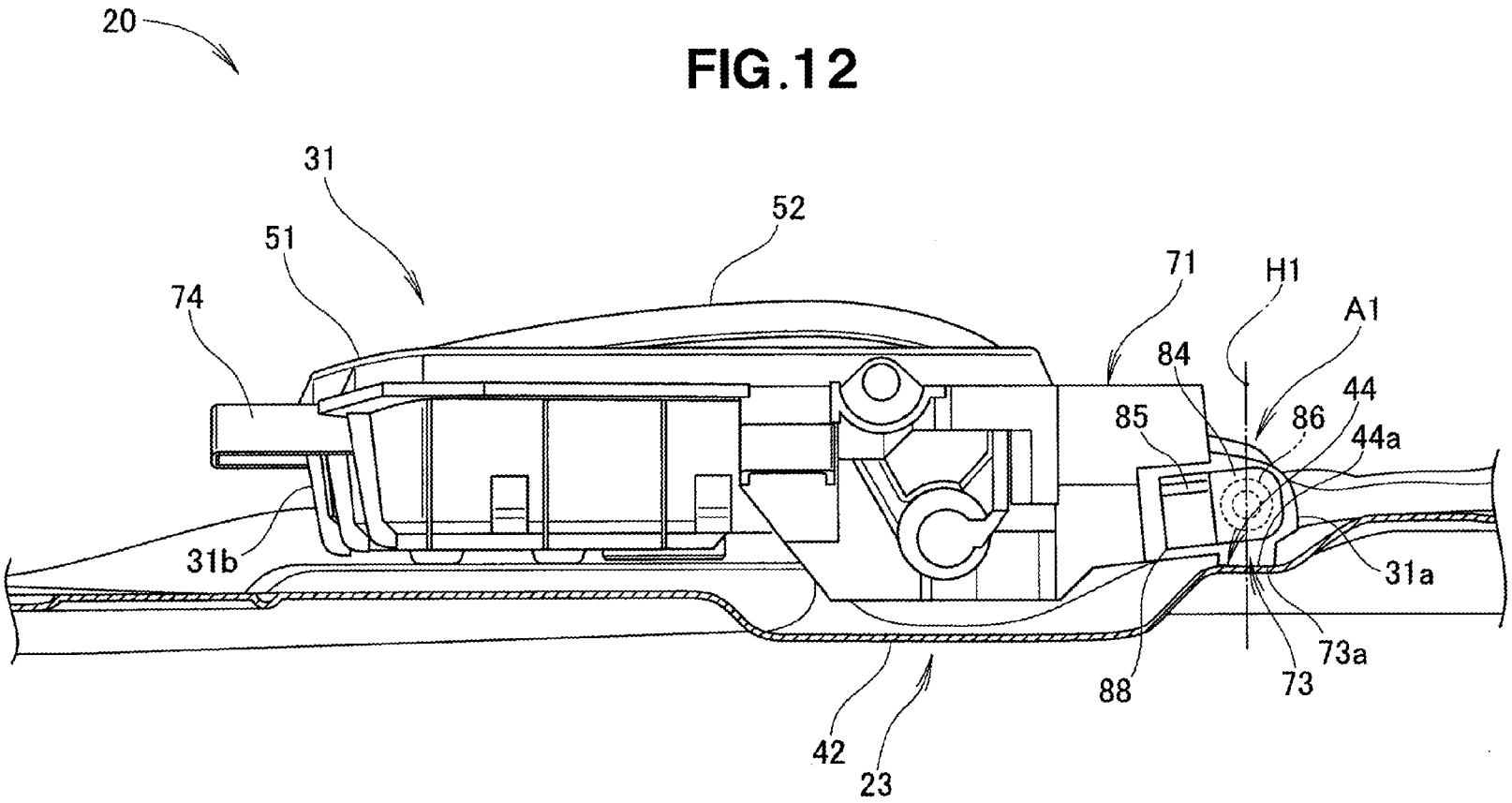
FIG. 12 is a bottom view of the handle device with the cable holding member in an engaging position.
Figure 13:
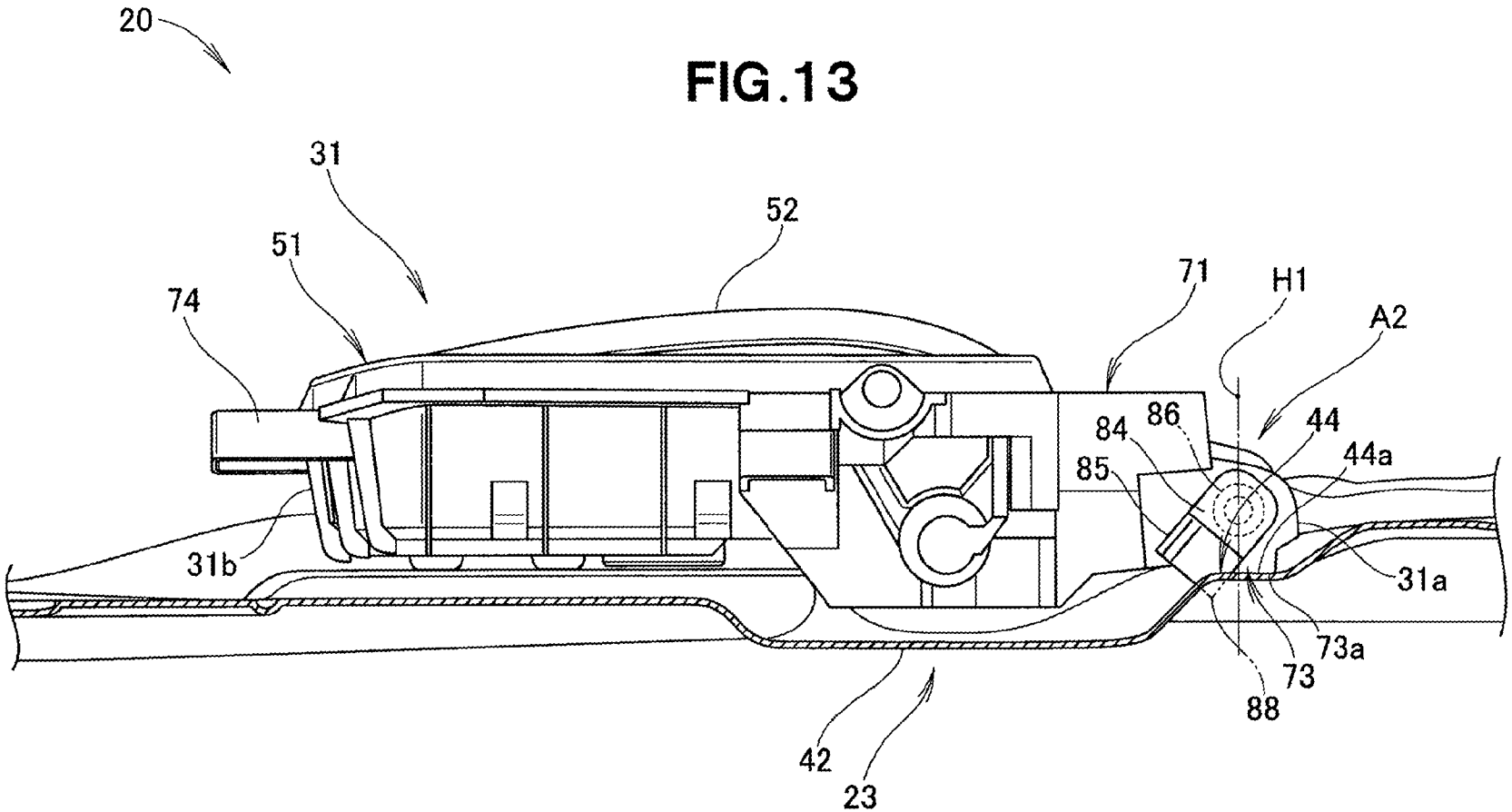
FIG. 13 is a bottom view of the handle device with the cable holding member in a non-engaging position.

As shown in FIG. 13, the U-shaped cable fitting portion 85 has a bottom defining a protrusion portion 88. When the cable holding member 58 is located in the non-engaging position A2, the protrusion portion 88 protrudes toward the door panel 23 more than a door-panel abutment surface 73*a* of the door-panel-side end portion 73 close to the interference portion 44 of the door panel 23 (the inner panel 42). As shown in FIG. 12, when the cable holding member 58 is located in the engaging position A1, the protrusion portion 88 is disposed in a stowed position closer to an inside of the handle device 31 than the door-panel abutting surface 73*a* of the door-panel-side end portion 73. The inside of the handle device 31 is defined as facing laterally of the vehicle 10 (i.e., the inside faces a direction perpendicular to an abutting surface 44*a* of the interference portion 44). More specifically, the inside of the handle device 31 is located facing the passenger compartment 12. It is noted that, in another embodiment, the handle device 31 may include not the inner handle 52 but the outer handle 24 in which case the inside of the handle device 31 is located facing the outside of the vehicle 10.

As shown in FIG. 12, that is, the engaging position A1 is defined as a position in which the protrusion portion 88 of the cable holding member 58 does not interfere with the interference portion 44 of the door panel 23 (the inner panel 42). As shown in FIG. 13, the non-engaging position A2 is defined as a position in which the protrusion portion 88 of the cable holding member 58 interferes with the interference portion 44 of the door panel 23 (the inner panel 42).

Figure 6:
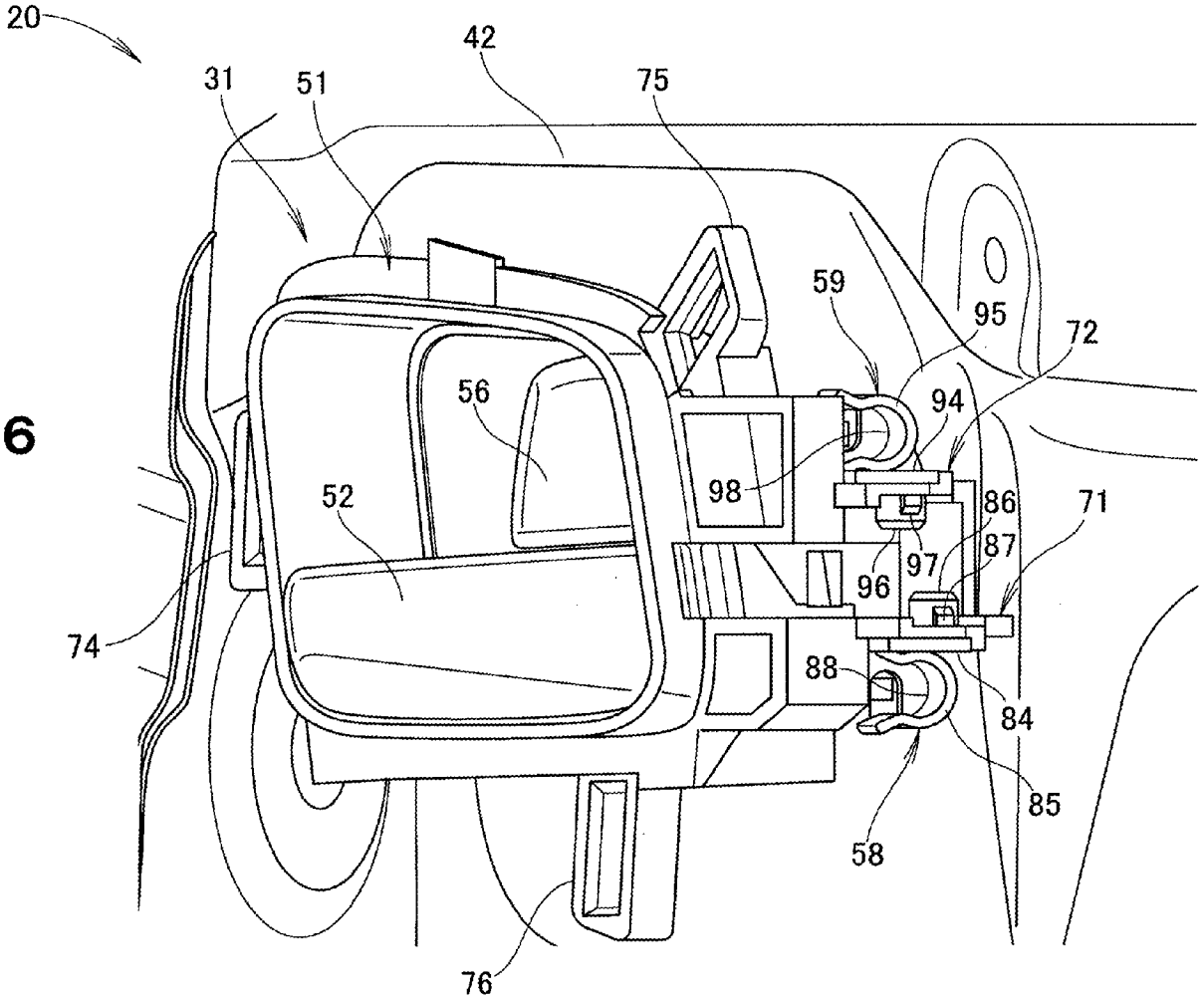
FIG. 6 is a perspective view of the handle device shown in FIG. 5 as the handle device is viewed from a rear part of the passenger compartment.

As shown in FIG. 6 and FIG. 10, the lock-side cable holding member 59 is identical in structure to the cable holding member (the latch-side cable holding member) 58 and includes a base portion 94, a cable fitting portion 95, a pivotal shaft 96 and engagement teeth 97, 97 (only one shown). The U-shaped cable fitting portion 95 has a bottom defining a protrusion portion 98.

A detailed description of the door-panel-side end portion 73 is made below with reference to FIG. 11 to FIG. 13. The door-panel-side end portion 73 is one part of the handle base 51 and is located near the attachment portion (the latch-side attachment portion) 71. The door-panel-side end portion 73 is a generally rectangular abutment rib protruding toward the interference portion 44 of the door panel 23. The door-panel-side end portion 73 abuts on the interference portion 44 when the handle device 31 is attached to the door panel 23. In addition, the door-panel-side end portion 73 is located within a region through which a line H1 extending from a center of the pivotal shaft 86 perpendicularly to the interference portion 44 passes.

In other words, the door-panel-side end portion 73 is aligned with the pivotal shaft 86 in a direction of abutment of the door-panel-side end portion 73 onto the interference portion 44. The direction of the abutment onto the interference portion 44 is a direction of attachment of the handle device 31, which direction is the same as a lateral direction of the vehicle 10 and perpendicular to the abutting surface 44*a* of the interference portion 44.

The door-panel-side end portion 73 is located near the attachment portion (the latch-side attachment portion) 71. The door-panel-side end portion 73 is disposed near the cable holding member (the latch-side cable holding member) 58 and located inside the farthest end of the entire handle device 31.

Figure 7:
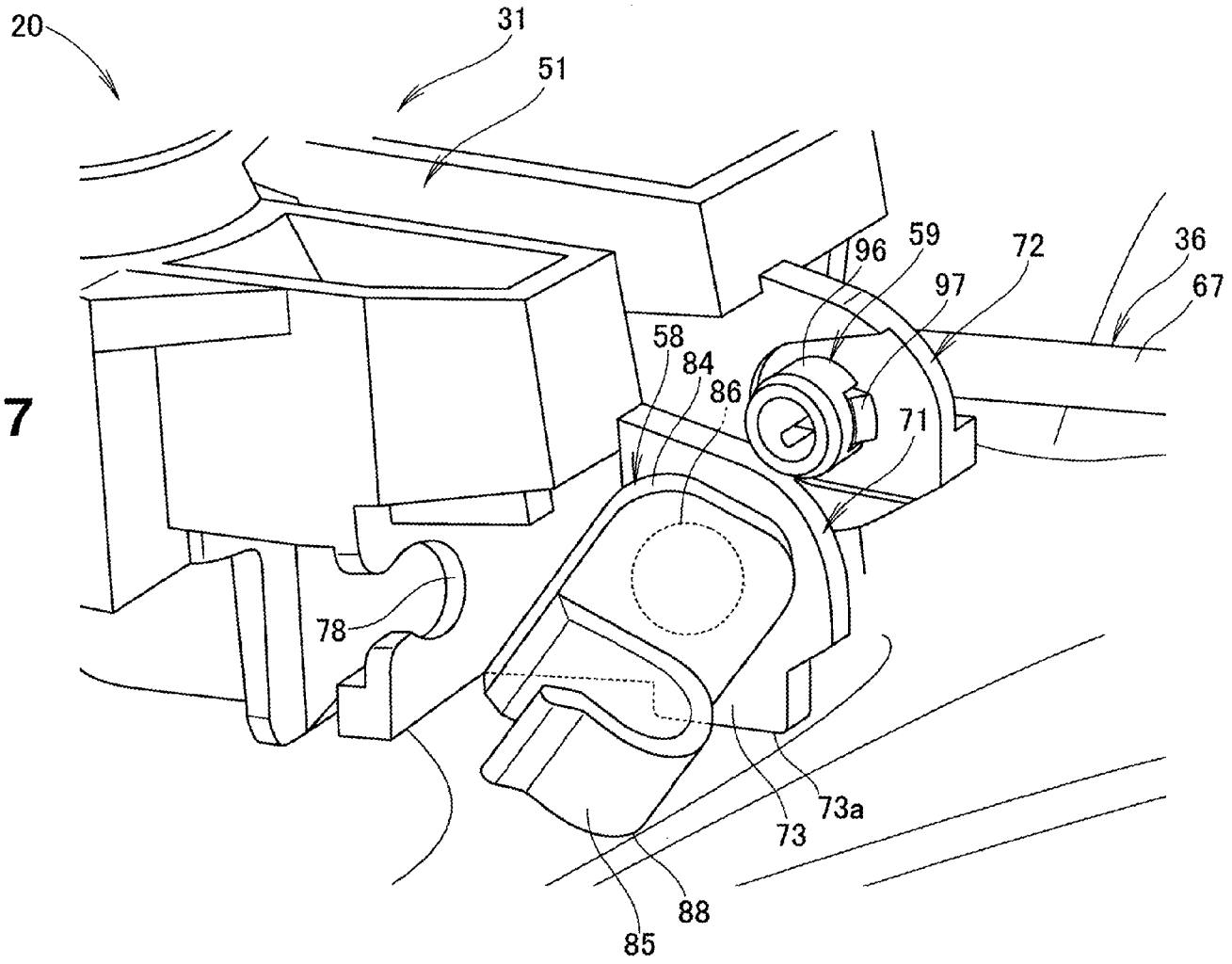
FIG. 7 is a perspective view of a cable holding member shown in FIG. 6 before attachment of a cable.

Next, a process for attaching the cable (the latch-side cable) 35 to the handle device 31 is discussed with reference to FIG. 7 to FIG. 9. As shown in FIG. 7, the pivotal shaft 86 of the cable holding member (the latch-side cable holding member) 58 is set in the engagement hole 81 (FIG. 10) of the attachment portion (the latch-side attachment portion) 71 before the handle device 31 is attached to the inner panel 42 (FIG. 6). In this state, the protrusion portion 88 (defined by the bottom of the U-shaped cable fitting portion 85) is set protruding toward the door panel 23 (FIG. 3) more than the door-panel abutment surface 73*a* of the door-panel-side end portion (the abutment rib) 73. That is, the cable holding member 58 is set in the non-engaging position A2 (FIG. 13).

Then, as shown in FIG. 8, the fitting groove 63 of the cable (the latch-side cable) 35 is brought to fittingly engage the latch fitting portion 78 of the handle base 51, as indicated by an arrow b1. Subsequently, the cable holding member 58 is caused to pivot on the pivotal shaft 86, as indicated by an arrow b2, to come close to the cable 35, after which the cable holding member (the latch-side cable holding member) 58 holds the cable (the latch-side cable) 35.

In other words, the cable holding member 58 is attached to the handle base 51 of the handle device 31 in such a manner as to move between the engaging position A1 (FIG. 12) to engage the cable 35 and the non-engaging position A2 (FIG. 13) not to engage the cable 35.

As a result, as shown in FIG. 9, the cable holding member 58 supports the cable 35 with the U-shaped cable fitting portion 85 of the cable holding member 58 fittingly engaging the tubular portion 64 of the cable 35 when the cable holding member 58 is disposed in the stowed position closer to the inside of the handle device 31 than the door-panel-side end portion 73. That is, the cable holding member 58 is set in the engaging position A1 (FIG. 12).

With the cable holding member 58 being located in the engaging position A1 (FIG. 12), the handle device 31 is attached to the inner panel 42. For example, as shown in FIG. 13, with the cable holding member 58 being located in the non-engaging position A2, the protrusion portion 88 of the cable holding member 58 abuts on the interference portion 44 of the door panel 23. This means that it is possible to find that the cable holding member 58 is not in the engaging position A1 in attaching the handle device 31 to the inner panel 42.

In other words, the protrusion portion 88 interferes with the interference portion 44 only when the cable holding member 58 is in the non-engaging position A2.

Figure 3:
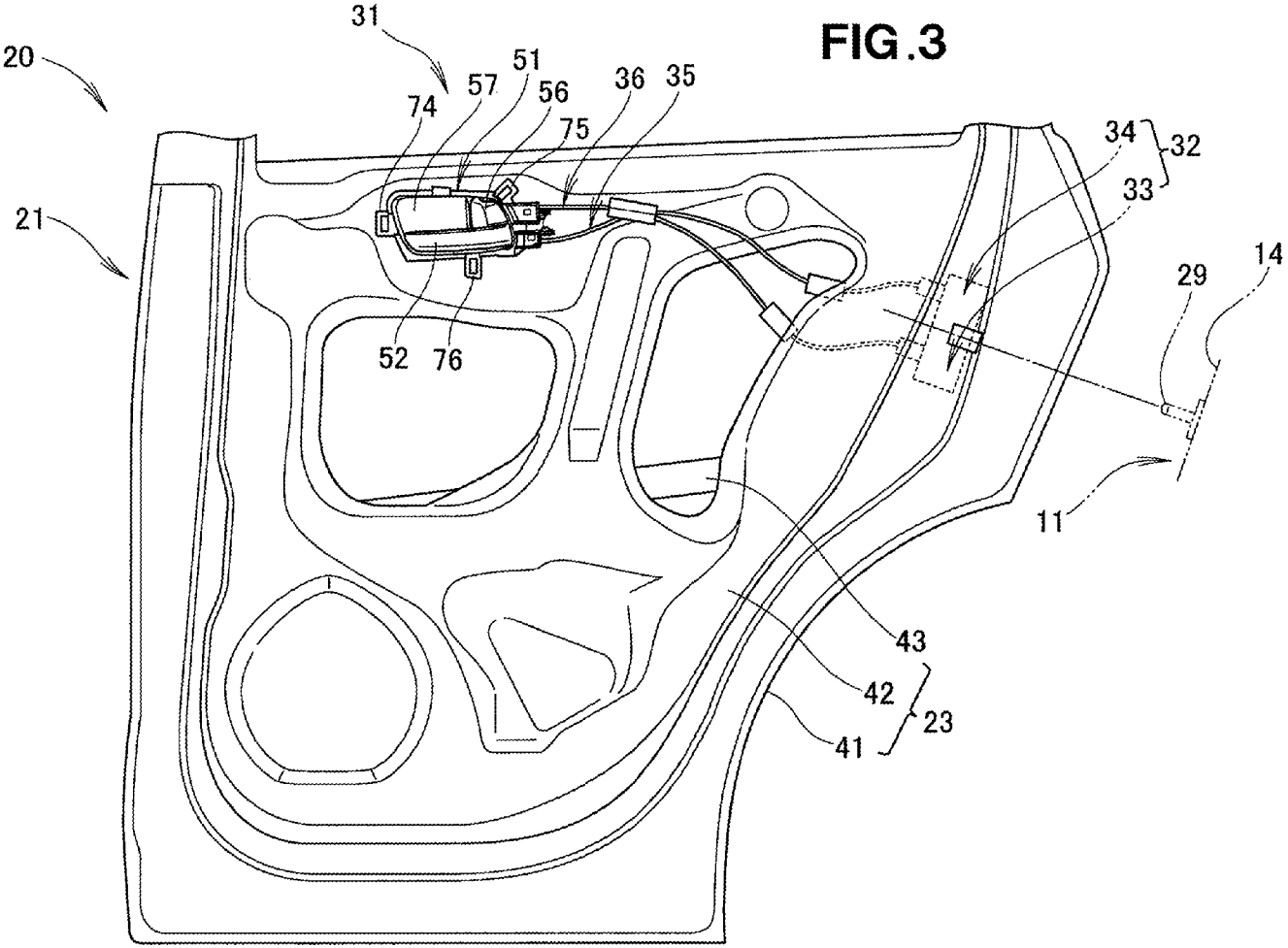
FIG. 3 is a side elevation view of each of a handle device and a door panel of the door shown in FIG. 2.

As shown in FIG. 1 to FIG. 3, the vehicular door 20 includes the door body 21 for opening and closing the door opening 14 of the vehicle body 11, the handle device 31 to be attached to the door panel 23 of the door body 21, the lock unit 32 for engaging the door body 21 with the vehicle body 11, the cable 35 interconnecting the handle device 31 and the lock unit 32, and the cable holding member 58 (FIG. 9) attached to the handle device 31 and movable between the engaging position A1 (FIG. 12) in which the cable holding member 58 engages the cable 35 and the non-engaging position A2 (FIG. 13) in which the cable holding member 58 does not engage the cable 35.

As shown in FIG. 12 and FIG. 13, the door panel 23 has the interference portion 44 to interfere with the cable holding member 58 in the non-engaging position A2 and avoid interfering with the cable holding member 58 in the engaging position A1 when the handle device 31 is attached to the door panel 23.

By virtue of the interference portion 44, it is possible to judge whether the cable holding member 58 is in the engaging position A1 in attaching the handle device 31 to the door panel 23. In other words, there is no need to perform an additional operation of confirming whether the cable holding member 58 is in the engaging position A1. As a result, a work of assembling the cable holding member 58 can be improved.

As shown in FIG. 12 and FIG. 13, in the vehicular door 20, the cable holding member 58 (FIG. 10) includes the protrusion portion 88. When the cable holding member 58 is in the non-engaging position A2, the protrusion portion 88 protrudes toward the door panel 23 more than the door-panel-side end portion 73 of the handle device 31 located close to the interference portion 44 of the door panel 23, and when the cable holding member 58 is in the engaging position A1, the protrusion portion 88 is disposed in the stowed position closer to the inside of the handle device 31 than the door-panel-side end portion 73. The protrusion portion 88 interferes with the interference portion 44 when the cable holding member 58 is in the non-engaging position A2. Since the protrusion portion 88 is configured to be disposed in the stowed position when the cable holding member is in the engaging position A1 and interfere with the interference portion 44 when the cable holding member is in the non-engaging position A2, it is possible to eliminate an additional operation of confirming whether the cable holding member 58 is in the engaging position A1. As a result, a work of assembling the cable holding member 58 can be improved.

Figure 11:
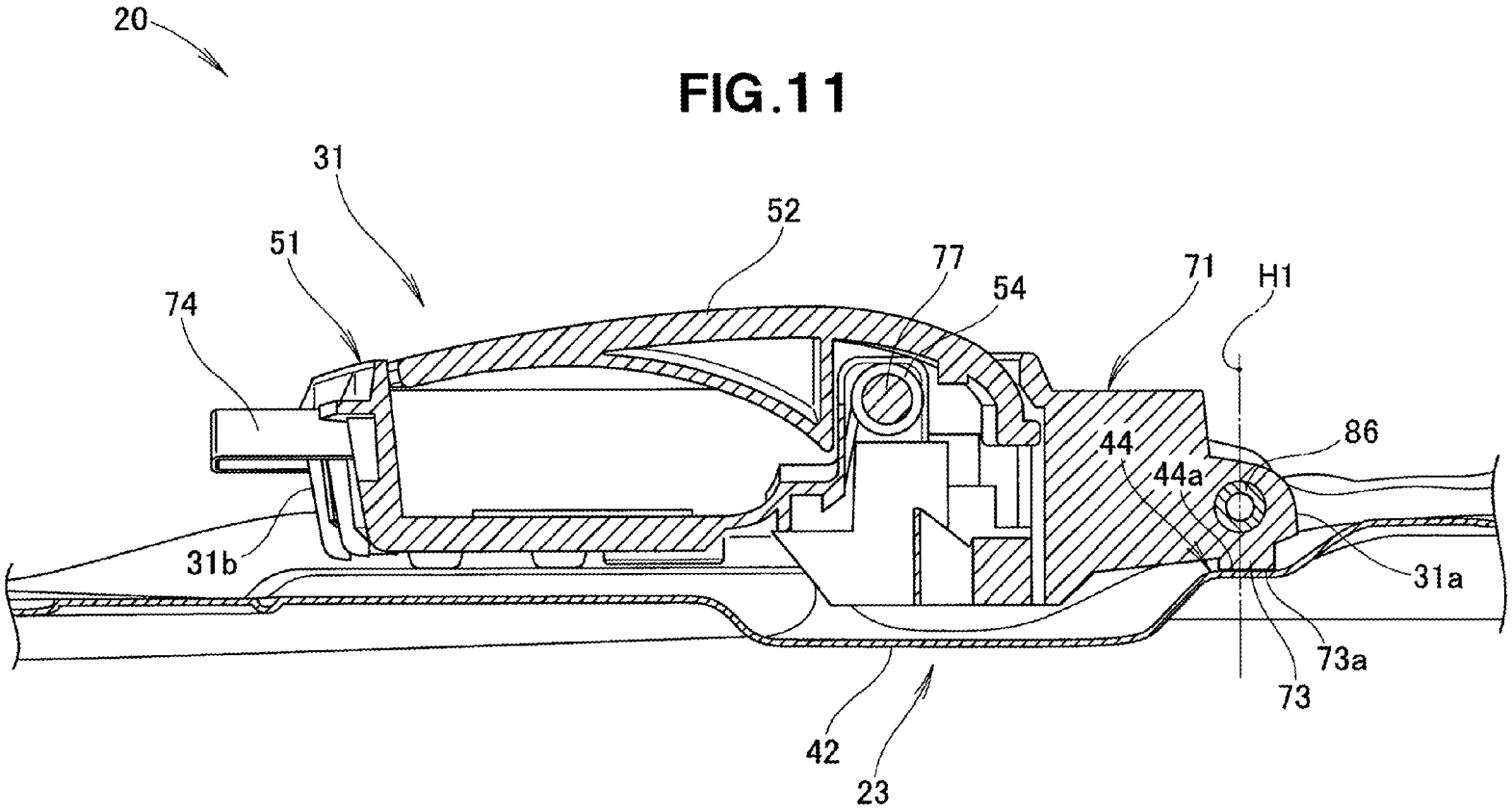
FIG. 11 is a cross-sectional view taken along line 11-11 of FIG. 5.

As shown in FIG. 11, in the vehicular door 20, the door-panel-side end portion 73 abuts on the interference portion 44 when the handle device 31 is attached to the door panel 23. The abutment of the door-panel-side end portion 73 on the interference portion 44 prevents the handle device 31 from rattling. Since the interference portion 44 is used to prevent the rattling of the handle device 31, a structure of the handle device 31 can be simplified.

Further, in the vehicular door 20, the handle device 31 includes the attachment portion 71 to which the cable holding member 58 (FIG. 10) is attached, and the door-panel-side end portion 73 is located near the attachment portion 71. Since the attachment portion 71 to which the cable holding member 58 is attached is oriented in such a direction as to abut on the interference portion 44, the cable holding member 58 can be more rigidly attached to the attachment portion 71, thereby effectively restraining shake of the cable 35.

Furthermore, in the vehicular door 20, the cable holding member 58 (FIG. 10) is pivotably attached to the attachment portion 71 through the pivotal shaft 86 of the cable holding member 58, and the door-panel-side end portion 73 is located in the region through which the line H1 extending from the center of the pivotal shaft 86 perpendicularly to the interference portion 44 passes. The pivotal shaft 86 can be thus supported due to the abutment on the interference portion 44. As a result, the cable holding member 58 can be more rigidly attached to the attachment portion 71.

As shown in FIG. 11 to FIG. 13, in the vehicular door 20, the door-panel-side end portion 73 is the generally rectangular abutment rib protruding toward the interference portion 44. The door-panel-side end portion 73 has a large surface abutting on the interference portion 44, and the attachment portion 71 provides increased rigidity.

Additionally, in the vehicular door 20, the door-panel-side end portion 73 is located on the side of the longitudinal one end 31*a* of the handle device 31. That is, the longitudinal one end 31*a* of the handle device 31 can be supported by the interference portion 44. As a result, it becomes possible to more effectively restrain rattling of the handle device 31.

As shown in FIG. 5 and FIG. 11, in the vehicular door 20, the handle device includes handle device attaching portions 91, 92 located on the side of the longitudinal opposite end 31*b* of the handle device 31 for attaching the handle device 31 to the door panel 23.

The side of the one end 31*a* of the handle device 31 is supported by the interference portion 44 and the handle device attaching portions 91, 92 are located on the side of the longitudinal opposite end 31*b* of the handle device 31. That is, the handle device attaching portions 91, 92 are efficiently disposed and rattling of the handle device 31 is effectively restrained.

In the embodiment, as shown in FIG. 7 to FIG. 9, the latch-side cable 35 interconnecting the handle device 31 and the latch device 33 has been discussed as an exemplary cable. The exemplary cable may be the lock-side cable 36 interconnecting the handle device 31 and the lock device 34.

The cable holding member (the latch-side cable holding member) 58 of the vehicular door in the present invention is pivotably attached to the attachment portion (the latch-side attachment portion) 71 in such a manner as to move between the engaging position and the non-engaging position, as shown in FIG. 7 to FIG. 9, but may be slidably attached to the attachment portion 71.

The vehicular door in the present invention is the rear door disposed at the rear part of the vehicle body 11, as shown in FIG. 1, but may be a front door.

The handle device attaching portions 91, 92 of the vehicular door in the present invention are fastened to the fastening holes 93*a*, 93*b* of the inner panel 42 by means of the clips (not shown), as discussed in relation to FIG. 4 and FIG. 5, but may be bolted to the fastening holes 93*a*, 93*b*.

INDUSTRIAL APPLICABILITY

The vehicular door in the present invention is suitable for use in a car such as a sedan or ban.

REFERENCE SIGNS LIST

11 . . . a vehicle body, 14 . . . a door opening, 20 . . . a vehicular door, 21 . . . a door body, 23 . . . a door panel, 31 . . . a handle device, 31*a* . . . longitudinal one end of the handle device, 31*b* . . . longitudinal opposite end of the handle device, 32 . . . a lock unit, 35 . . . a cable (a latch-side cable), 44 . . . an interference portion of the door panel, 58 . . . a cable holding member (a latch-side cable holding member), 71 . . . an attachment portion (a latch-side attachment portion), 73 . . . a door-panel-side end portion (an abutment rib), 86 . . . a pivotal shaft of the cable holding member, 88 . . . a protrusion portion of the cable holding member, 91, 92 . . . handle device attaching portions, A1 . . . an engaging position, A2 . . . a non-engaging position, H1 . . . a line perpendicular to the interference portion

The invention claimed is:

1. A vehicular door apparatus comprising:

a door body for opening and closing a door opening of a vehicle body, the door body having an inner door panel and an outer door panel;

a handle device to be attached to the inner door panel of the door body, the handle device being separate from the inner door panel;

a lock unit for locking the door body with the vehicle body;

a cable interconnecting the handle device and the lock unit;

a cable holding member attached to the handle device and movable between an engaging position in which the cable holding member engages the cable and a non-engaging position in which the cable holding member does not engage the cable, wherein the inner door panel has a contact portion that contacts the cable holding member when the cable holding member is in the non-engaging position and that is spaced from the cable holding member when the cable holding member is in the engaging position, wherein the cable holding member includes a protrusion portion, wherein when the cable holding member is in the non-engaging position and the handle device is being assembled to the inner door panel, the protrusion portion protrudes toward the inner door panel more than a door-panel-side end portion of the handle device, the door-panel-side end portion being in contact with the contact portion of the inner door panel when the handle device is assembled to the inner door panel, and when the cable holding member is in the engaging position, the protrusion portion is disposed in a stowed position spaced from the contact portion of the inner door panel, wherein when the cable holding member is in the non-engaging position and the handle device is being assembled to the inner door panel, the protrusion portion contacts the contact portion such that the contact portion interferes with the assembly of the handle device to the inner door panel, and wherein when the cable holding member is in the engaging position and the handle device is being assembled to the inner door panel, the protrusion portion is spaced from the contact portion such that the contact portion does not interfere with the assembly of the handle device to the inner door panel.

2. The apparatus of claim 1, wherein the handle device includes an attachment portion to which the cable holding member is attached, and wherein the attachment portion includes the door-panel-side end portion.

3. The apparatus of claim 2, wherein the cable holding member is pivotably attached to the attachment portion through a pivotal shaft of the cable holding member, and the door-panel-side end portion is aligned with the pivotal shaft in a direction perpendicular to the contact portion.

4. The apparatus of claim 3, wherein the door-panel-side end portion is an abutment rib held in contact with the contact portion when the handle device is assembled to the inner door panel.

5. The apparatus of claim 2, wherein the door-panel-side end portion is an abutment rib held in contact with the contact portion when the handle device is assembled to the inner door panel.

6. The apparatus of claim 1, wherein the door-panel-side end portion is located at one end of the handle device.

7. The apparatus of claim 6, wherein the handle device includes handle device attaching portions located at an end of the handle device opposite from the one end of the handle device, and the handle device attaching portions attach the handle device to the inner door panel.

* * * * *